US008983360B2

(12) United States Patent
Kikuchi et al.

(10) Patent No.: US 8,983,360 B2
(45) Date of Patent: Mar. 17, 2015

(54) METHOD AND SYSTEM FOR PRINTING HAVING A WEB JAM DETECTING UNIT

(75) Inventors: Soushi Kikuchi, Ibaraki (JP); Yuuki Kikushima, Ibaraki (JP); Sho Sawahata, Ibaraki (JP); Hidenori Takayasu, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 344 days.

(21) Appl. No.: 12/946,285

(22) Filed: Nov. 15, 2010

(65) Prior Publication Data

US 2011/0123203 A1 May 26, 2011

(30) Foreign Application Priority Data

Nov. 20, 2009 (JP) ..... 2009-265695

(51) Int. Cl.
*G03G 15/00* (2006.01)
*G03G 15/23* (2006.01)

(52) U.S. Cl.
CPC ..... *G03G 15/70* (2013.01); *G03G 15/238* (2013.01); *G03G 15/6517* (2013.01); *G03G 2215/00021* (2013.01); *G03G 2215/00455* (2013.01); *G03G 2215/00548* (2013.01); *G03G 2215/00666* (2013.01); *G03G 2221/1675* (2013.01)
USPC ..... 399/384; 399/21

(58) Field of Classification Search
CPC .. G03G 15/70; G03G 15/238; G03G 15/6517
USPC ..... 399/384, 21, 391; 400/583
See application file for complete search history.

(56) References Cited

U.S. PATENT DOCUMENTS

| | | | | |
|---|---|---|---|---|
| 6,560,415 | B2 * | 5/2003 | Hirako et al. | 399/18 |
| 7,920,279 | B2 * | 4/2011 | Ernst et al. | 358/1.12 |
| 2007/0212130 | A1 * | 9/2007 | Kuwabara et al. | 399/316 |

FOREIGN PATENT DOCUMENTS

| | | | | |
|---|---|---|---|---|
| JP | 63-66574 | | 3/1988 | |
| JP | 04125170 | A * | 4/1992 | B41J 11/42 |
| JP | 5-147790 | | 6/1993 | |
| JP | 6-127746 | | 5/1994 | |
| JP | 11-15305 | | 1/1999 | |
| JP | 2004-238165 | | 8/2004 | |

(Continued)

OTHER PUBLICATIONS

Office Action issued Jun. 18, 2013 in Japanese Patent Application No. 2009-265695.

*Primary Examiner* — Judy Nguyen
*Assistant Examiner* — Justin Olamit
(74) *Attorney, Agent, or Firm* — Oblon, McClelland, Maier & Neustadt, L.L.P.

(57) ABSTRACT

A printing system including: a first printer that forms an image on continuous-form printing paper, and includes a pre-heating unit that preliminarily heats the continuous-form printing paper prior to fixation and a fixing unit that performs the fixation; and a second printer that forms an image on the continuous-form printing paper fed from the first printer. The second printer includes a jam detecting unit that detects, at a detection position upstream of a position where the second printer forms the image on the continuous-form printing paper, and a control unit that controls the jam detecting unit such that the jam detection is not performed for a period of time, over which a deformed portion of the continuous-form printing paper which has been at rest at the pre-heating unit of the first printer passes through the detection position of the jam detecting unit.

12 Claims, 10 Drawing Sheets

(56) References Cited

FOREIGN PATENT DOCUMENTS

| | | |
|---|---|---|
| JP | 3680989 | 5/2005 |
| JP | 2008-44750 | 2/2008 |
| JP | 2009-53288 | 3/2009 |
| JP | 2009-220312 | 10/2009 |
| JP | 2010-076162 | 4/2010 |

* cited by examiner

FIG. 3

| BUFFER POSITION [inch] | BUFFER AMOUNT [mm] |
|---|---|
| UPPER LIMIT (+19/12") | 40.22 |
| 17/12" | 35.99 |
| 15/12" | 31.77 |
| 13/12" | 27.53 |
| 11/12" | 23.30 |
| 9/12" | 19.06 |
| 7/12" | 14.83 |
| 5/12" | 10.58 |
| 3/12" | 6.35 |
| 1/12" | 2.12 |
| NEUTRAL POSITION (0") | 0 |
| -1/12" | -2.12 |
| -3/12" | -6.35 |
| -5/12" | -10.58 |
| LOWER LIMIT (-10/12") | -21.17 |

METHOD AND SYSTEM FOR PRINTING HAVING A WEB JAM DETECTING UNIT

CROSS-REFERENCE TO RELATED APPLICATIONS

The present application claims priority to and incorporates by reference the entire contents of Japanese Patent Application No. 2009-265695 filed in Japan on Nov. 20, 2009.

BACKGROUND OF THE INVENTION

1. Field of the Invention

The present invention relates to a printing system that includes a first printer that forms an image on continuous-form printing paper and a second printer that receives the continuous-form printing paper fed from the first printer and forms an image on the continuous-form printing paper, and to a printing method.

2. Description of the Related Art

Conventionally, web printing systems (printing systems) have been proposed and brought into practical use as printing system that uses two printers to form images on both sides of elongated print paper (web) that has standard-compliant feed holes. An example of such a web printing system is disclosed in Japanese Patent No. 3680989.

FIG. 9 is a schematic perspective view illustrating basic configuration of a conventional web printing system. Referring to FIG. 9, the web printing system includes two printers P1 and P2 that are arranged in series and that form images on a web by electrophotography. The first printer P1 disposed upstream performs printing on a first surface (front side) of a web W. The web W is delivered from the first printer to a turnover device where the web W is turned upside down and then sent into the second printer P2 disposed downstream of the first printer. The second printer P2 performs printing on a second surface (back side) of the web W. The web printing system configured as described above includes a control device 20 that controls operations of the printer P1 and the printer P2.

FIG. 10 is an exemplary schematic diagram illustrating a configuration of the printer P1, P2 illustrated in FIG. 9. In FIG. 10, a printing process section of a web printing unit that employs electrophotographic method includes a photosensitive member 3. The photosensitive member 3 is configured to transfer and form an electrostatic latent image of a print image to the web W while rotating in a direction the web W is conveyed for printing. Various units (not illustrated) including an electrostatic charging unit, an exposure unit, a developing unit, and a cleaning unit, which are used in forming the electrostatic latent image on the surface of the photosensitive member 3, are provided in the periphery of the photosensitive member 3.

In both lateral-side portions of the web W, standard-compliant feed holes (which engage with the conveying unit 1 and 5, and will be described later), for conveying the web W, are provided continually at regular intervals along the web conveying direction. The web conveying unit 1 is disposed upstream of a transfer device 4 in the web conveying direction, and the web conveying unit 5 is disposed downstream of the transfer device 4 in the web conveying direction. The web conveying units 1 and 5 convey the web W through a transfer region while applying a certain tension on the web W. A web-jam detecting sensor 2 is attached to the web conveying unit 1. The web-jam detecting sensor 2 is configured to detect a jam of the web W.

The web conveying units 1 and 5 convey the web W to a thermal fixing device. The thermal fixing device includes a pre-heating plate 6, a heating roller 7, and a pressure roller 8. The pre-heating plate 6 is a heating plate that preheats the web W so that fixation is performed reliably by the heating roller 7 and the pressure roller 8. A puller roller 9 conveys the web W having undergone fixation to discharge the web W to the outside of the printer through a shooter 10. A buffer mechanism 15 is provided to adjust slack in the web W. The buffer mechanism 15 is configured to be pivotable about its pivot center, which is an end of the buffer mechanism 15 on an upstream side relative to the feed direction of the web W.

FIG. 11 is an exemplary schematic diagram illustrating a configuration of a conventional web conveying unit. Referring FIG. 11, the web conveying unit 1 includes tractor pins 11, which are to be inserted into the standard-compliant feed holes H for conveying the web W, tractor doors 12 having a mechanism that freely opens and closes the tractor doors 12, and web-jam detectors 2*a* and 2*b* movable to open and close in synchronization with the tractor doors 12. The above described elements are arranged in a pair. The web-jam detecting sensor 2 may be, for instance, a web-jam sensor of a transmission type; more specifically, the web-jam detecting sensor 2 may be a light-sensitive detector that includes a pair of the web-jam detector 2*a* that emits sensor light 13 and the web-jam detector 2*b* that receives the sensor light 13.

In FIG. 11, only portions of the tractor doors 12, which are portions near the web-jam detectors 2*a* and 2*b*, are illustrated.

FIG. 12 is a schematic cross-sectional view illustrating how the web-jam detectors 2*a* and 2*b* operate. When the web W is jammed at the web conveying unit 1 as indicated by a dotted line in FIG. 12 and causes the sensor light 13 to be shielded by the web W, the web-jam detector 2*b* does not receive the sensor light 13 any more. The web-jam detector 2*b* detects a jam of the web W in this manner.

The web-jam detectors 2*a* and 2*b* are configured to open and close in synchronization with the tractor doors 12. Accordingly, the web-jam detector 2*b* detects a web jam even when the web-jam detector 2*b* is prevented from receiving the sensor light 13 because one of the tractor doors 12 is open or because the tractor door 12 is lifted up by a jam of the web W.

In the web printing system configured as described above, the web-jam detecting sensor 2 detects a jam of the web W irrespective of operations of the first printer P1 and the second printer P2.

However, such an unfavorable situation as described below may occur in the conventional technique described above.

For instance, when printing operation pauses due to a trouble or the like or when printing operation is halted by an operator because of other circumstance, the web W is left as being loaded in the first printer P1 and the second printer P2 in a state where no printing is performed. Under such circumstances, the web W pausing in the thermal fixing device of the first printer P1 continues to be heated by the pre-heating plate 6 and the heating roller 7. Thus, as time passes, the moisture in the web W evaporates, and the web W partially and greatly shrinks and deforms due to heat.

When printing is resumed from such a state as described above, the web W that has the portion greatly deformed by heat shrinkage (hereinafter, "thermally shrunk portion") is conveyed to the turnover device to be turned upside down and then fed into the second printer P2. When the thermally shrunk portion passes through the web conveying unit 1 of the second printer P2, the tractor door 12 may be lifted up due to the shape of the thermally shrunk portion, disadvantageously causing the web-jam detecting sensor 2 to detect a web jam in some cases.

SUMMARY OF THE INVENTION

It is an object of the present invention to at least partially solve the problems in the conventional technology.

According to an aspect of the present invention, a printing system includes: a first printer that forms an image on continuous-form printing paper; and a second printer that receives the continuous-form printing paper fed from the first printer and forms an image on the continuous-form printing paper, and the first printer includes: a pre-heating unit that preliminarily heats the continuous-form printing paper prior to fixation; and a fixing unit that fixes a not-yet-fixed image formed on the continuous-form printing paper onto the continuous-form printing paper, and the second printer includes: a jam detecting unit that detects a jam of the continuous-form printing paper at an upstream position where the second printer forms the image on the continuous-form printing paper; and a control unit that controls the jam detecting unit such that the jam detecting unit does not perform the jam detection for a period of time, over which a deformed portion of the continuous-form printing paper that has been at rest at the pre-heating unit of the first printer passes through the detection position of the jam detecting unit.

According to another aspect of the present invention, a printing method to be performed in a printing system that includes a first printer that forms an image on continuous-form printing paper and a second printer that receives the continuous-form printing paper fed from the first printer and forms an image on the continuous-form printing paper, the first printer including: a pre-heating unit that preliminarily heats the continuous-form printing paper prior to fixation; and a fixing unit that performs the fixation by fixing a not-yet-fixed image onto the continuous-form printing paper, the printing method including: performing jam detection by detecting a jam of the continuous-form printing paper in the second printer at an upstream position where the second printer forms the image on the continuous-form printing paper; and performing control in the second printer such that the jam detection is not performed for a period of time, over which a deformed portion of the continuous-form printing paper that has been at rest at the pre-heating unit of the first printer passes through the detection position of the jam detecting unit.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is an explanatory diagram illustrating an example buffer-amount table;

DETAILED DESCRIPTION OF THE PREFERRED EMBODIMENTS

Figure 1:
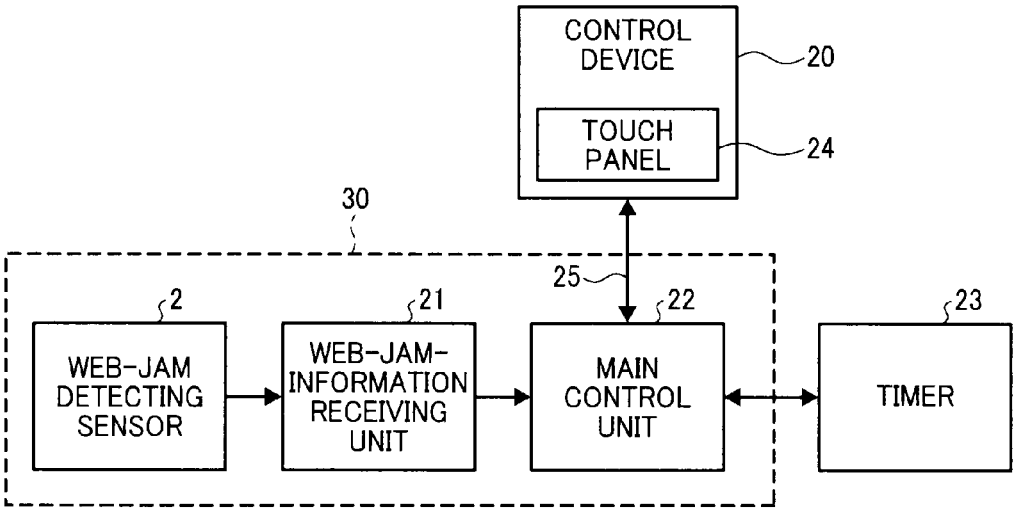
FIG. 1 is a block diagram illustrating an example of relevant elements of a signal processing system related to web-jam detection performed in printers P1 and P2 according to an embodiment of the present invention.

Exemplary embodiments of the present invention are described in detail below with reference to the accompanying drawings.

Basic configuration of a printing system according to an embodiment of the present invention is similar to the configuration of the conventional system illustrated in FIGS. 9 to 12. Accordingly, elements that are same as those in FIGS. 9 to 12 are denoted by like reference numerals and symbols.

Figure 2:
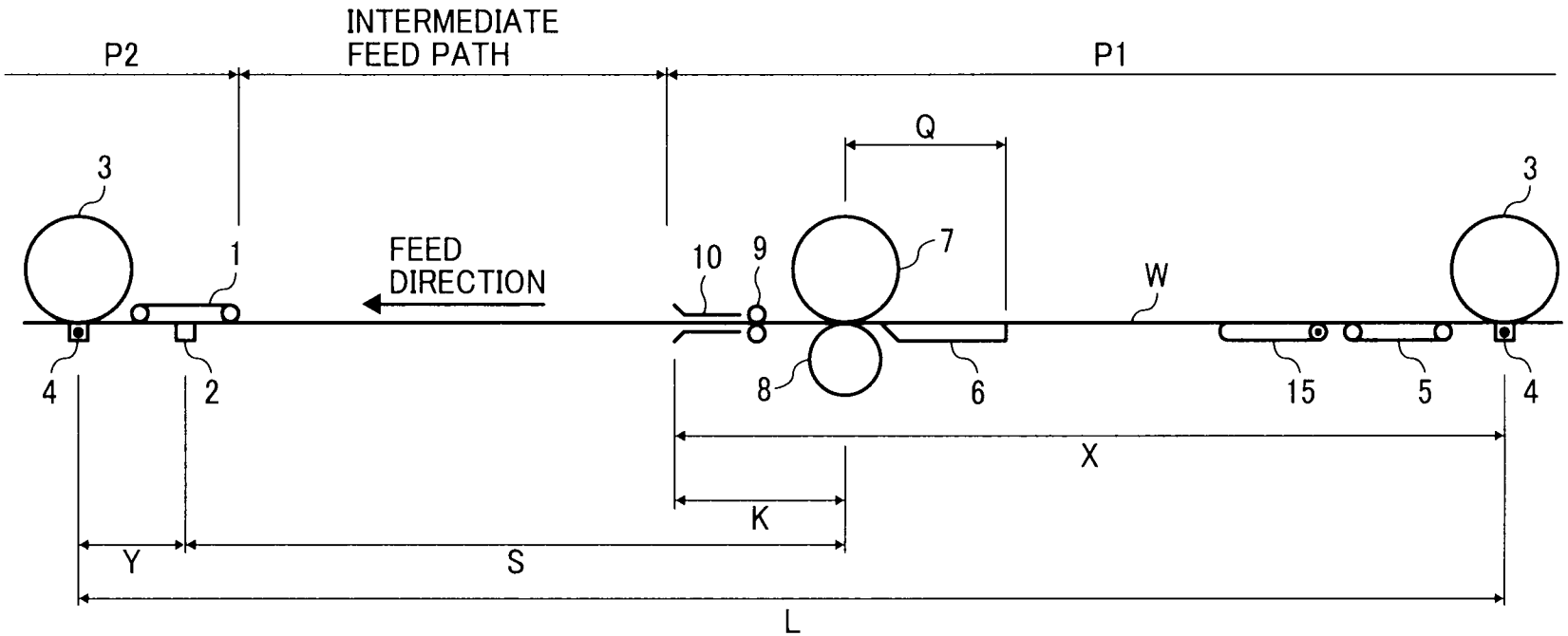
FIG. 2 is a schematic diagram illustrating, in a developed manner, elements located on a feed path of a web W between a transfer point of the printer P1 and a transfer point of the printer P2.

FIG. 1 is a block diagram illustrating an example of relevant elements of a signal processing system related to web-jam detection performed in the printers P1 and P2 illustrated in FIG. 2. Each of the printers P1, P2 includes a web-jam detecting unit 30 that detects a web jam by using the web-jam detecting sensor 2, which is a integral portion of the tractor doors 12 (see FIGS. 11 and 12) of the web conveying unit 1.

Referring to FIG. 1, the web-jam detecting unit 30 includes the web-jam detecting sensor 2, a web-jam-information receiving unit 21, and a main control unit 22. The web-jam detecting sensor 2 may be a web-jam sensor of a transmission type similar to the sensor described above with reference to FIG. 12; more specifically, the web-jam detecting sensor 2 may be a light-sensitive detector that includes a pair of the web-jam detectors 2*a* that emits the sensor light 13 and the web-jam detector 2*b* that receives the sensor light 13. By providing the web-jam detecting unit 30 with the web-jam detecting sensor 2, false detection caused by undulation of a web can be prevented.

The web-jam-information receiving unit 21 determines whether a web jam has occurred during printing based on a detection signal fed from the web-jam detecting sensor 2. Upon web jam detection, the web-jam-information receiving unit 21 transmits web-jam information to the main control unit 22.

Upon receiving the web-jam information, the main control unit 22 recognizes that a web jam has occurred, stops printing, and transmits a notification of the web jam detection to the control device 20. Meanwhile, the main control unit 22 includes a timer 23 serving as a timepiece.

As described above, the web printing system includes the control device 20 (see FIG. 9) that controls printing performed by the printer P1 and the printer P2. The control device 20 may be provided on either one of the printers P1 and P2, or, alternatively, independent from the printers P1 and P2.

Each of the main control units 22 of the printer P1 and P2 is coupled to the control device 20 via a communication channel 25. Although the communication channel 25 is schematically indicated by a solid line in FIG. 1, the communication channel 25 may be realized by an appropriate communication medium, such as wired communication, wireless communication, or optical communication.

The control device 20 is configured to communicate with each of the main control units of the printers P1 and P2 and read information from each other. The control device 20 includes a touch panel 24 for displaying information for an operator and receiving information entered by an operator.

When the web printing system configured as described above is in a paused state, the web W continues to be heated by the pre-heating plate 6 and the heating roller 7 that partially greatly deform the web W. Hence, a thermally shrunk portion is formed on the web W.

Conveyance of the web W is resumed as the printing is resumed. During a period where the thermally shrunk portion formed on the web W by the printer P1 passes through the web conveying unit of the printer P2, the thermally shrunk portion may lift up the tractor door 12, which may cause the web-jam detecting sensor 2 to make false detection of a web jam.

To this end, in the present embodiment, false detection of a web jam resulting from detection of the thermally shrunk portion by the web-jam detecting sensor 2 is prevented from by not allowing the printer P2 to perform the web-jam detection operation for a period, over which the thermally shrunk portion passes through a detection position of the web-jam detecting sensor 2 of the printer P2.

FIG. 2 is a schematic diagram illustrating, in a developed manner, elements located on a feed path of the web W between a transfer point of the printer P1 and a transfer point of the printer P2.

Referring to FIG. 2, an operator inputs and sets L, which is the length between the transfer point (position of the transfer device 4) of the printer P1 and the transfer point of the printer P2 of the web W loaded on a web feed path, to the control device 20 through the touch panel 24 in advance.

The length of L is a fixed value having been set so as to allow the printer P2 to print an image of an original or the like on a back side a page which corresponds to the front side on which the printer P1 has printed an image of an original or the like. The buffer mechanism 15 serving as an adjusting unit that allows slack in the web W and adjusts the slack to thereby keep the length L constant is disposed at a portion indicated with the caption "INTERMEDIATE FEED PATH" in FIG. 2. In FIG. 2, the web W is illustrated as being tensioned tight and extending linearly; however, the web W has slack at each of the buffer mechanism 15 and the intermediate feed path.

When resuming printing, the control device 20 transmits the length L between the transfer point of the printer P1 and the transfer point of the printer P2 of the web W loaded on the web feed path to the main control unit 22 of the printer P2 via the communication channel 25.

In the main control unit 22 of the printer P2, a distance X from the transfer point of the printer P1 to a leading end of the shooter 10 of the printer P1, a distance Y from the web-jam detecting sensor 2 of the printer P2 to the transfer point of the printer P2, and a distance K from a nip between the heating roller 7 and the pressure roller 8 of the printer P1 to the leading end of the shooter 10 of the printer P1 are stored in advance. The main control unit 22 calculates a timing (error mask timing) T, which is a period of time that elapses before the thermally shrunk portion reaches the web-jam detecting sensor 2 of the printer P2, from Equation (I):

$$T=S/Z=(L-X-Y+K)/Z \quad \text{(I)}$$

where S is the distance from the nip between the heating roller 7 and the pressure roller 8 of the printer P1 to the web-jam detecting sensor 2 of the printer P2, and Z is print speed of the printers.

When the distance from the transfer point of the printer P1 to the nip between the heating roller 7 and the pressure roller 8 of the printer P1 is assigned to X in Equation (I), the need of taking the distance K into account is eliminated.

Meanwhile, the buffer mechanism 15 is provided to absorb the difference between a conveyance speed of the web W by the web conveying unit 5 and a conveyance speed of the web W by the heating roller 7 and the pressure roller 8. The buffer mechanism 15 keeps the tension placed on the web W constant by changing a pivot angle of the buffer mechanism 15. Accordingly, the distance X from the transfer point to the leading end of the shooter 10 varies because the amount of the slack in the web W on the feed path varies depending on operation of the buffer mechanism 15. The amount of the slack in the web W on the feed path is referred to as a buffer amount (adjustment amount), depending on which the distance X varies.

In contrast, the distance L is a fixed value as described above. This causes a necessity for making a change to the error mask timing T obtained from Equation (I) depending on the buffer amount. Hence, the distance X is desirably set to different value by displacing with the buffer amount.

The pivot angle of the buffer mechanism 15 is classified into a plurality of levels (e.g., five levels) and assumed as buffer positions. The buffer mechanism 15 of the printer P1 includes a position sensor unit, such as an angle sensor or an encoder, which measures the pivot angle thereof. A transmitting unit of the printer P1 transmits the pivot angle of the buffer mechanism 15 obtained by the position sensor unit to the control device 20.

The control device 20 receives the pivot angle from the printer P1 and transmits it to the printer P2. The main control unit 22 of the printer P2 receives the pivot angle from the control device 20 and determines a buffer amount associated with a buffer position of a pivot-angle level, into which the pivot angle is classified. The buffer amount is determined with reference to a reference distance X that is taken in a neutral state where the buffer mechanism 15 is pivoted by a neutral pivot angle, which is a median of pivot angles.

The printer P2 stores a buffer-amount table, which corresponds to an adjustment-amount table, which contains buffer amounts associated with pivot angles of the buffer mechanism 15 of the printer P1 with reference to a reference buffer position in a storage medium, such as memory. The reference buffer position is a buffer position in the neutral state where the buffer mechanism 15 is pivoted by the neutral pivot angle.

FIG. 3 is an explanatory diagram illustrating an example buffer-amount table. As illustrated in FIG. 3, buffer positions and buffer amounts associated with each other are stored in the buffer-amount table. The buffer position is a position that corresponds to a pivot angle detected by an angle sensor, an encoder, or the like. The buffer amount is a value, which varies depending on the distance X, and varies relative to the reference buffer amount obtained in the neutral state.

Figure 4:
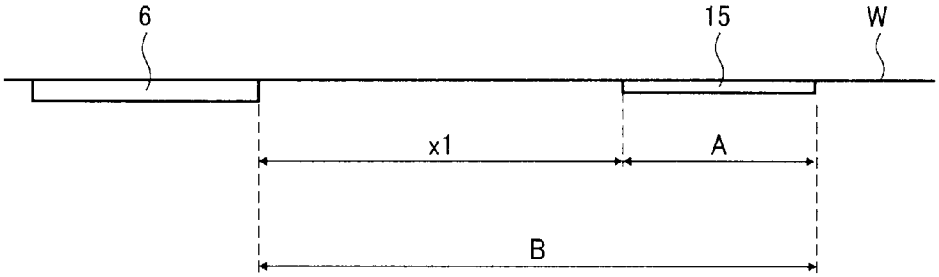
FIG. 4 is an explanatory diagram of calculation of a buffer amount.

In FIG. 3, the lower limit position is the position of a minimum pivot angle in a range where the buffer mechanism 15 can pivot as illustrated in FIG. 4. The upper limit position is a position where the buffer mechanism 15 is pivoted by a maximum pivot angle.

When printing pauses, the main control unit 22 obtains the buffer amount that corresponds to a pivot angle of the buffer mechanism 15 in this paused state by referring to the buffer-length table stored in the memory. The main control unit 22 performs addition or subtraction of the buffer amount to or from the reference distance X, thereby obtaining a corrected value of the distance X. The main control unit 22 sets this corrected value as a value to be assigned to X in Equation (I).

The main control unit 22 of the printer P2 calculates the error mask timing T from Equation (I) whereas the main control unit 22 of the printer P1 obtains information about the distance X for use in solving Equation (I). Therefore it is necessary to transfer the information about the distance X obtained by the main control unit 22 of the printer P1 to the main control unit 22 of the printer P2. This transfer may be preferably performed by the control device 20.

Assuming that the length of the thermally shrunk portion is approximately equal to Q, which is the distance from the pre-heating plate 6 to the heating roller 7 in the thermal fixing device, the main control unit 22 calculates M, which is a period of time for use in determining a web-jam-error masking period from Equation (II).

$$M=Q/Z \quad \text{(II)}$$

The main control unit 22 of the printer P2 is thus capable of recognizing, respectively, the error mask timing T, which is the time from the resumption of printing to the thermally shrunk portion reaches the web-jam detecting sensor 2; and the web-jam-error masking period (period M), for which error detected in the web-jam detection is to be masked, and which is the period of time, over which the thermally shrunk portion passes through the web-jam detecting sensor 2 (period of time required for passage). Accordingly, the main control unit 22 is thus capable of setting a period of time, in which web-jam detection control is not performed, by causing the timer 23 to count (measure) elapsed time from start of printing, which is notified by the control device 20.

In the example described above, the value of the distance X for use in calculating the timing T from Equation (I) has been determined based on the pivot angle of the buffer mechanism 15 in the printing-paused state; however, the timing T may alternatively be obtained by using a fixed value as the distance X. In this alternative configuration, a distance from the transfer point to the leading end of the shooter 10 in a state where the buffer amount of the buffer mechanism 15 is at its maximum is desirably used as the distance X in Equation (I). This allows the web-jam-error masking period to start prior to arrival of a leading end of the thermally shrunk portion at the web-jam detecting sensor 2 based on the time T irrespective of the pivot angle of the buffer mechanism 15.

In addition, the period M is desirably set to such a value that allows the web-jam-error masking period is set within a period the thermally shrunk portion passes through the web-jam detecting sensor 2 irrespective of buffer amount of the buffer mechanism 15. For instance, it is preferable to assign a sum of the distance of the difference between the minimum value and the maximum value of the buffer amount and the distance from the pre-heating plate 6 to the heating roller 7 to the distance Q in Equation (II).

Using fixed values as values of the timing T and the period M allows the main control unit 22 of the printer P2 to perform calculation by using the distances X, K, and Q calculated based on information about lengths of the feed paths and sizes of the units and the like of the printer P2 itself as the distances X, K, and Q of the printer P1 in Equations (I) and (II) because the printer P1 and the printer P2 are identical to each other in structure.

For a situation where the printer P1 and the printer P2 have different structures, for instance, a following configuration may be employed. The main control unit 22 of the printer P1 transmits the distances X, K, and Q of the printer P1 itself to the control device 20, and the control device 20 transmits the distances X, K, and Q to the main control unit 22 of the printer P2. This configuration allows the main control unit 22 of the printer P2 to obtain information about the distances X, K, and Q for use in solving Equations (I) and (II).

In the present embodiment, the buffer amount is obtained by accessing the buffer-amount table, in which the buffer positions and the buffer amounts are associated with each other, stored in the memory or the like in advance; however, a method for obtaining a buffer amount is not limited thereto. For instance, a configuration to be described below for dynamically calculating a buffer amount, which causes the distance X displace, based on the buffer position (pivot angle of the buffer mechanism 15) may be alternatively employed.

Figure 5:
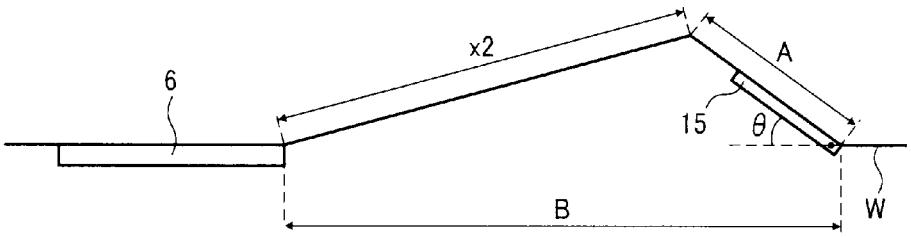
FIG. 5 is another explanatory diagram of calculation of a buffer amount.

FIGS. 4 and 5 are explanatory diagrams for calculating a buffer amount. FIG. 4 is a diagram of a situation where the buffer mechanism 15 is at the lower limit position. As illustrated in FIG. 4, in the situation where the buffer mechanism 15 is at the lower limit position, the main control unit 22 calculates x1, which is the distance from a distal end, which is on the opposite side from the pivot center, of the buffer mechanism 15 to the pre-heating plate 6, from Equation (III):

$$x1=B-A \quad \text{(III)}$$

where A is the length of the buffer mechanism 15, and B is the distance from the pivot center of the buffer mechanism 15 to the pre-heating plate 6.

The transmitting unit of the printer P1 transmits: A which is the length of the buffer mechanism 15; B which is the distance from the pivot center of the buffer mechanism 15 to the pre-heating plate 6; and θ which is the pivot angle of the buffer mechanism 15 detected by the position sensor unit of the printer P1, to the control device 20. The control device 20 transfers A, B, and θ to the printer P2. The main control unit 22 of the printer P2 receives A, B, and θ from the control device 20.

FIG. 5 is a diagram illustrating a situation where the buffer mechanism 15 has pivoted.

In this situation, the main control unit 22 calculates x2, which is the distance from the distal end of the buffer mechanism 15 to the pre-heating plate 6, from Equation (IV).

$$x2=\sqrt{(A^2+B^2-2AB\cos\theta)} \quad \text{(IV)}$$

The main control unit 22 uses Equations (III) and (IV), and the buffer mechanism 15 obtains the buffer amount Δx, which is a displacement of the web conveyance distance from the lower limit position using Equation (V).

$$\Delta x=x2-x1 \quad \text{(V)}$$

The main control unit 22 adds the buffer amount Δx obtained from Equation (V) to the distance X.

The method described above allows dynamic calculation of a buffer amount to thereby adjust the distance X.

Figure 6:
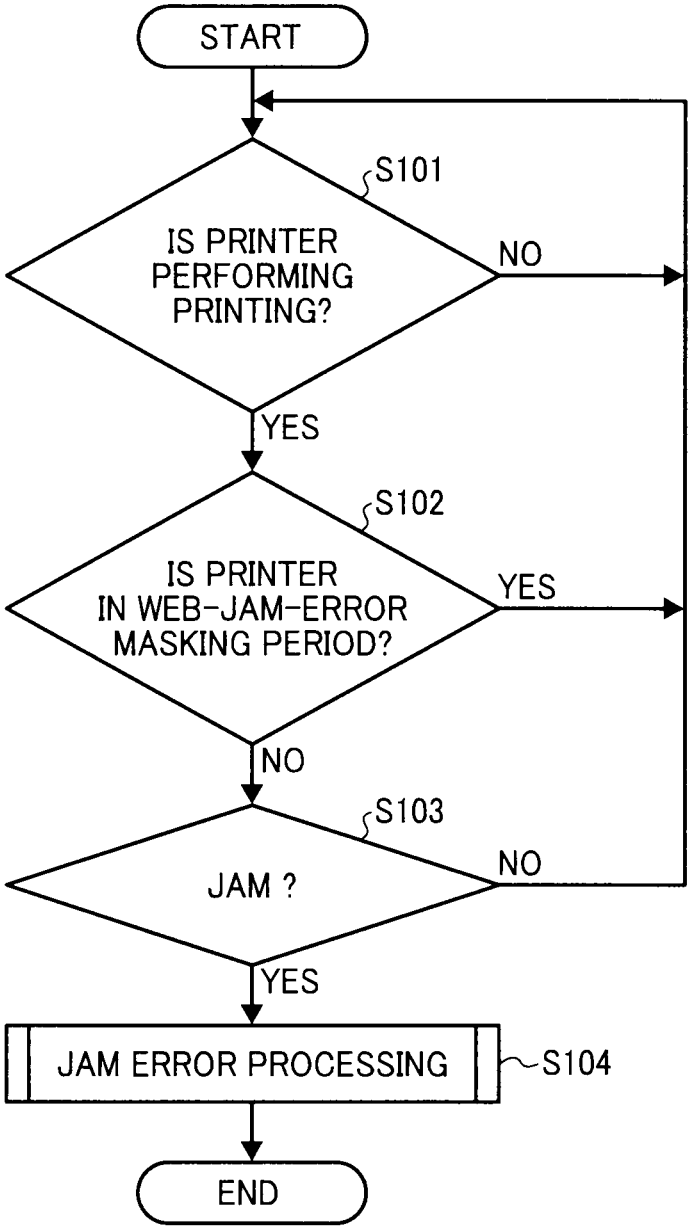
FIG. 6 is a flowchart illustrating an example control procedure for web-jam detection performed by a main control unit 22 according to the embodiment.

A web-jam detection control procedure performed by the printing system configured described above according to the present embodiment is described below. FIG. 6 is a flowchart illustrating an example control procedure for the web-jam detection performed by the main control unit 22 according to the present embodiment.

Referring to FIG. 6; the main control unit 22 monitors whether the printer is performing printing at Step S101. If the printer is performing printing (YES at Step S101), the main control unit 22 monitors whether the printer is in the web-jam-error masking period at Step S102. If the printer is in the web-jam-error masking period (YES at Step S102); the main control unit 22 does not perform the web-jam detection. If the printer is not in the web-jam-error masking period (NO at Step S102), the main control unit 22 monitors the web-jam detection at Step S103.

If the main control unit 22 detects a web jam (YES at Step S103), the main control unit 22 performs web-jam-error processing that includes transmitting a notification of occurrence of the web jam to the control device 20 and causing printing (web conveyance) to pause at Step S104.

In the procedure illustrated in FIG. 6, the web-jam detection is not performed during the web-jam-error masking period at Step S102. Alternatively, a method of preventing false detection of a web jam by, in lieu of setting the error masking period, increasing a required number of recheck times to determine that a web jam has occurred for the period corresponding to the web-jam-error masking period to thereby decrease sensitivity to web-jam error detection may be employed.

Figure 7:
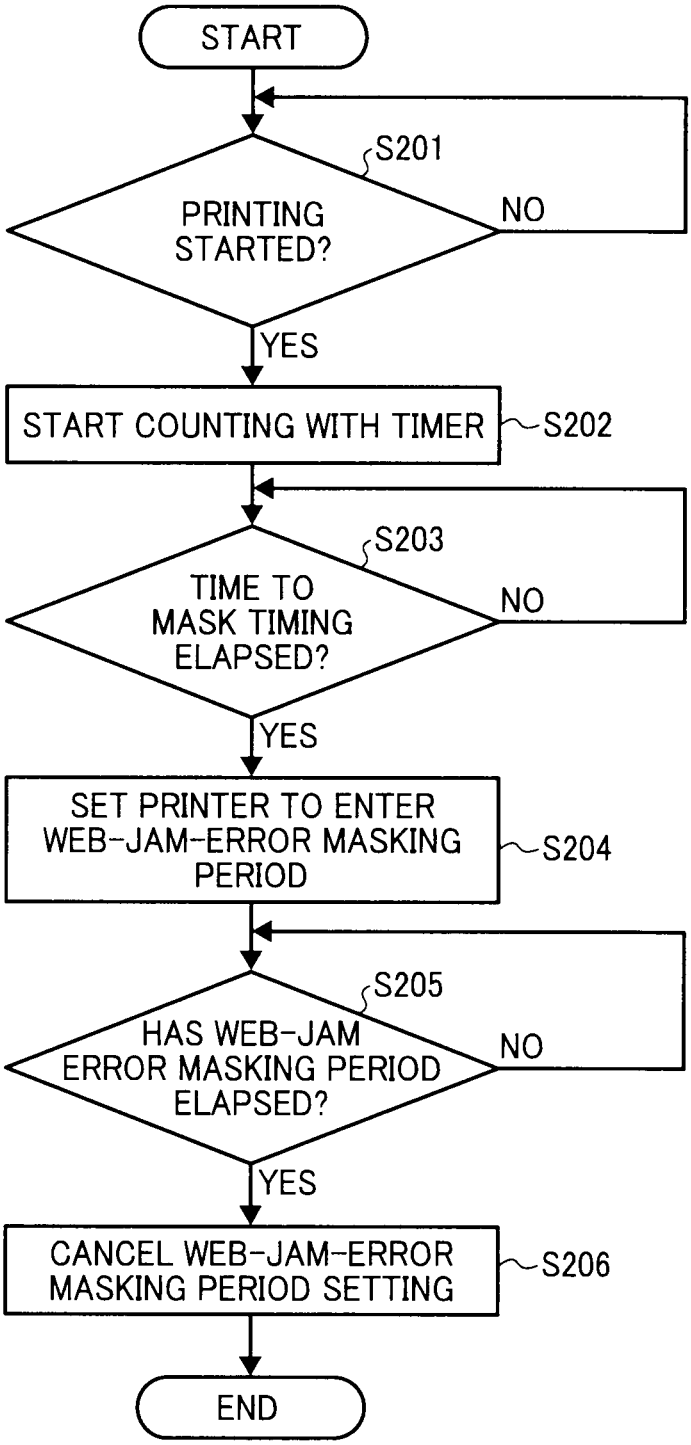
FIG. 7 is a flowchart illustrating an example procedure related to setting of a web-jam-error masking period to be referred to at Step S102 in the flowchart of FIG. 6.

FIG. 7 is a flowchart illustrating an example procedure related to setting of the web-jam-error masking period to be referred to at Step S102 in the flowchart of FIG. 6.

Referring to FIG. 7; the main control unit 22 monitors whether printing has been started at Step S201. If the printing has been started (YES at Step S201), the main control unit 22 causes the timer 23 to start counting time at Step S202.

The main control unit 22 monitors whether the error mask timing T calculated in advance (see Equation (I)) has elapsed at Step S203. If the time T has elapsed (YES at Step S203), it is indicated that a thermally shrunk portion has reached the web-jam detecting sensor 2. Accordingly, the main control unit 22 sets the printer to be the web-jam-error masking period at Step S204. Subsequently, the main control unit 22 monitors whether the period M, which is the web-jam-error masking period calculated in advance, has elapsed at Step S205. If the web-jam-error masking period M has elapsed (YES at Step S205), the main control unit 22 cancels the web-jam-error masking period setting (Step S206).

In the present embodiment, the web-jam-error masking period is determined by causing the timer 23 to count the period M calculated in advance based on the error mask timing T. However, the web-jam-error masking period may be determined by other method, example of which includes a method of defining the web-jam-error masking period by counting the number of printed pages.

Figure 8:
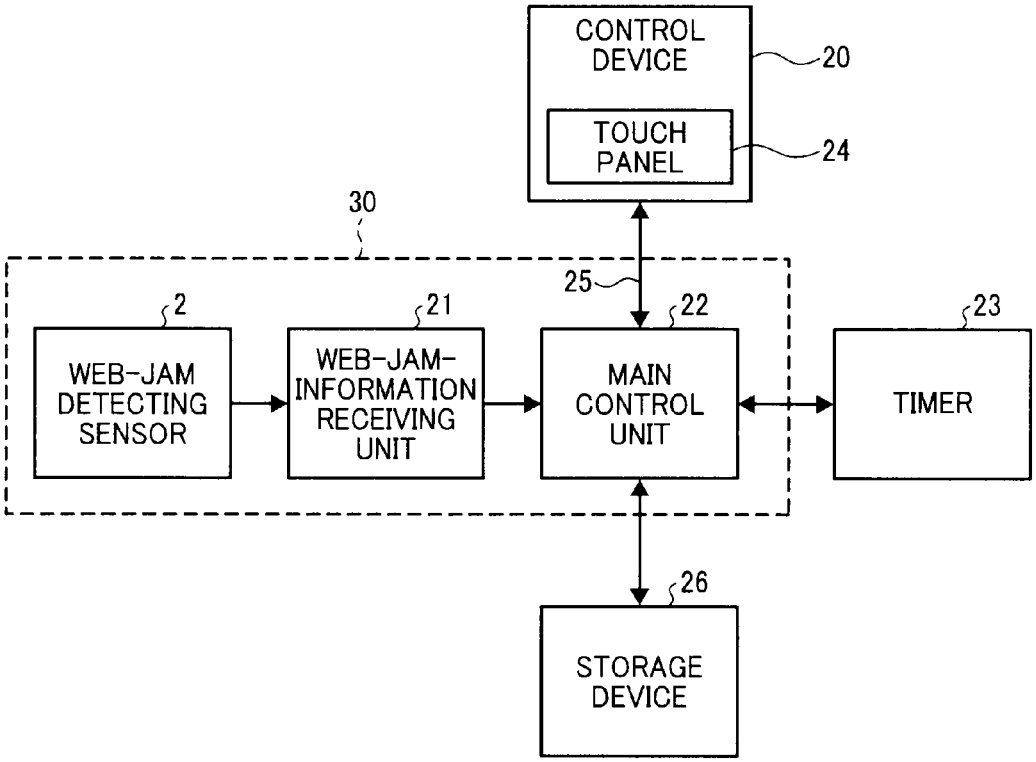
FIG. 8 is a block diagram illustrating another example of relevant elements of the signal processing system related to web-jam detection.
Figure 9:
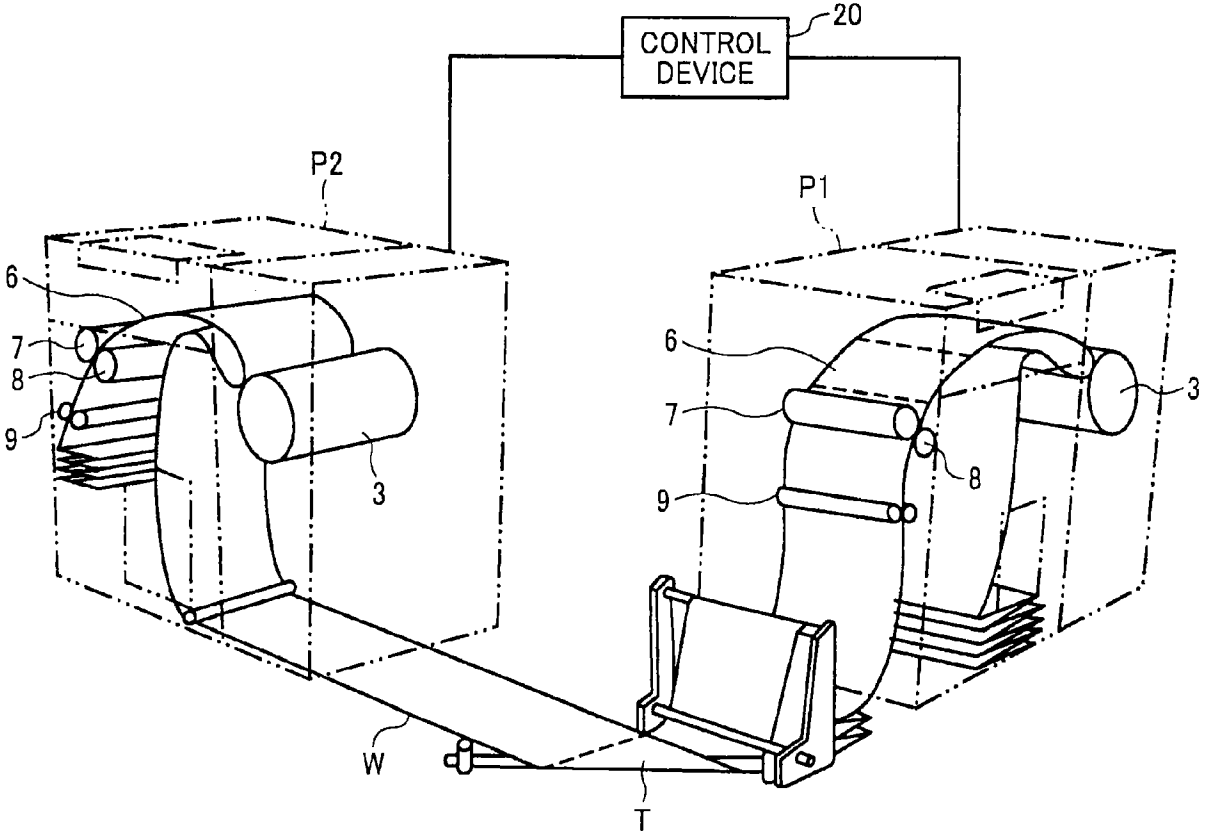
FIG. 9 PRIOR ART
FIG. 9 is a schematic perspective view illustrating basic configuration of a conventional web printing system that includes printers P1 and P2.
Figure 10:
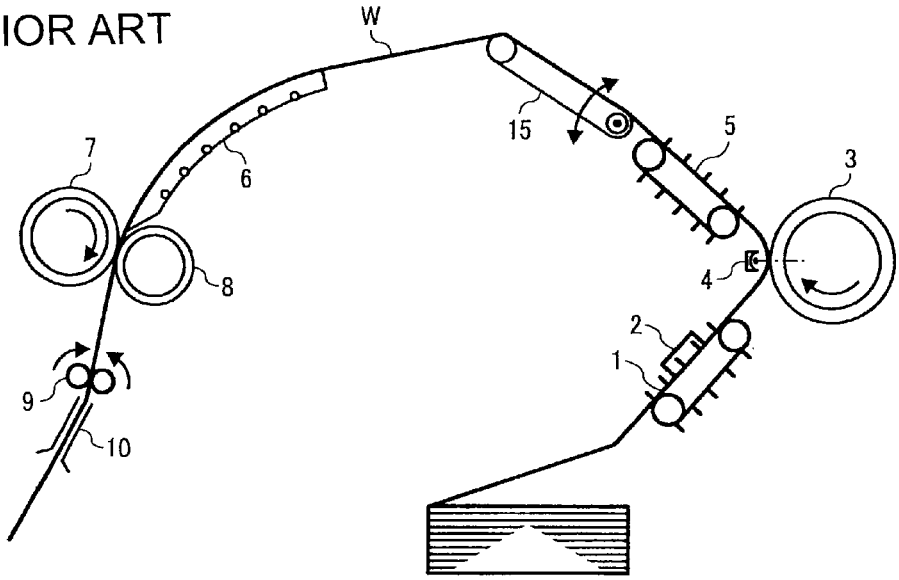
FIG. 10 PRIOR ART
FIG. 10 is a schematic configuration diagram illustrating an example configuration of the printer P1, P2 illustrated in FIG. 9.
Figure 11:
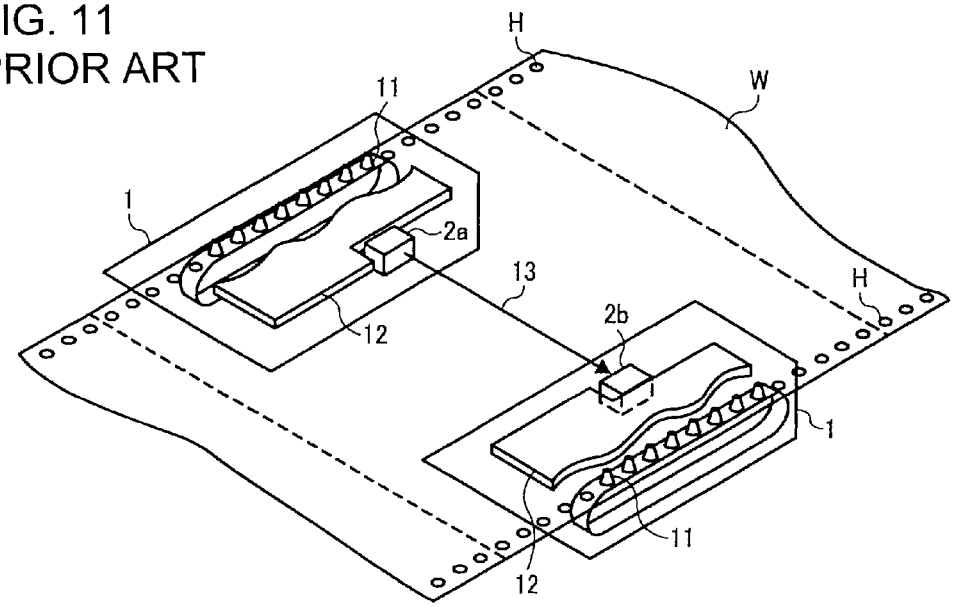
FIG. 11 PRIOR ART
FIG. 11 is a schematic configuration diagram illustrating an example configuration of a conventional web conveying unit.
Figure 12:
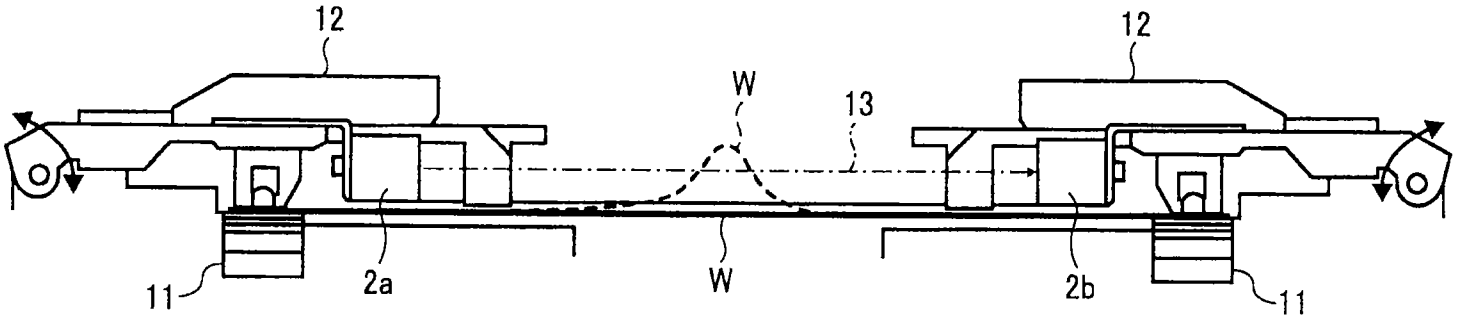
FIG. 12 PRIOR ART
FIG. 12 is a schematic cross-sectional view illustrating how web-jam detectors 2*a* and 2*b* operate.

FIG. 8 is a block diagram illustrating another example of relevant elements of the signal processing system related to the web-jam detection. In FIG. 8, elements identical or corresponding to those illustrated in FIG. 1 are denoted by like reference numeral and descriptions thereabout are omitted.

Referring to FIG. 8, when printing is resumed, the main control unit 22 calculates the timing T which is a time thermally shrunk portion reaches the printer P2. In a situation where after the printing is resumed, printing pauses before the thermally shrunk portion reaches the printer P2, another thermally shrunk portion is formed by the pre-heating plate 6 and the heating roller 7 of the printer P1 during a period, over which the printing pauses. Accordingly, at second resumption of the printing, or, put another way, when the printing is resumed for the second time, the web W has two thermally shrunk portions on the web feed path between the printer P1 and the printer P2.

In this case, the main control unit 22 calculates the error mask timing T1 of the thermally shrunk portion formed at first from Equation (VI):

$$T1 = T - Tp \quad \text{(VI)}$$

where Tp is a period of time (in other words, print duration) that has elapsed from resumption of the printing until the printing pauses again.

If calculated value of the time T1 is equal to or greater than one, the main control unit 22 stores the value in a storage device 26.

The main control unit 22 counts, when printing is resumed for the second time, each of the error mask timing T (see Equation (I)) and the error mask timing T1 related to arrival of the thermally shrunk portion at the printer P2. When the time has elapsed, the main control unit 22 sets the printer to enter a web-jam-error masking period of the period M to thereby mask the web-jam detection for each of the thermally shrunk portions. This allows masking of an error resulting from detection of a web jam to be started at each of points in time where the thermally shrunk portions individually reach the web-jam detecting sensor 2, thereby allowing appropriate web-jam detection.

In the example described above, it is assumed that there are two thermally shrunk portions on the web. However, the main control unit 22 is adaptable to a situation where there are three or more thermally shrunk portions by calculating, for each of the thermally shrunk portions, time that is to elapse before the thermally shrunk portion reaches the web-jam detecting sensor 2 of the printer P2 by performing similar calculation to that according to Equation (VI) and storing results of the calculation in the storage device 26.

In a case when the printing pauses in the middle of a web-jam-error masking period of the web-jam detecting sensor 2. The main control unit 22 stops a process that corresponds to the web-jam-error masking period. When resuming the printing, it is possible to deal with the above described situation by resuming the operations that correspond to the paused web-jam-error masking period.

According to the embodiment described above, the web printing system free from false detection of a web jam in the printer P2 even when printing is resumed from a paused state can be provided. Prevention against false detection of a web jam that may be caused by a thermally shrunk portion that has been at rest at the pre-heating plate 6 of the printer P1 may be achieved. Prevention against false detection that may be caused due to a plurality of thermally shrunk portions may also be achieved.

In the embodiment discussed above, the printer P1 forms an image on the first surface of the web W while the printer P2 forms an image on the second surface of the web W; however, the present invention is similarly applicable to a configuration where the printer P2 additionally forms an image of the first surface of the web W as well.

In the embodiment described above, the standard-compliant feed holes H are created in both lateral-side portions of the web W so that the web W is conveyed by the web conveying units 1 and 5; however, the present invention is similarly applicable to a configuration where the holes H are not created in both lateral-side portions of the web W.

In the embodiment described above, the printer P1 and the printer P2 are identical to each other in structure; however, the present invention is similarly applicable to a configuration where the printer P1 and the printer P2 have different structures.

The embodiments and modifications described above may be combined appropriately without departing from the scope of the present invention. In the embodiments described above, printing paper is used as the web; however, the present invention is similarly applicable to a configuration where a thermally deformable print medium, such as film, is used as the web.

The present invention is applicable to any printing system that includes a first printer that forms an image on elongated print medium by performing image forming process that involves thermal fixing and a second printer that receives the print medium with the image printed thereon fed from the first printer and forms an image on the print medium that is conveyed at the same conveyance speed as that in the first printer irrespective of image forming process and structure of the second printer.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing system comprising:

a first printer that forms a first image on continuous form printing paper to obtain a first-image-printed continuous-form printing paper;

a second printer that receives the first-image-printed continuous-form printing paper fed from the first printer and forms a second image on the first-image-printed continuous-form printing paper;

a control unit that controls printing performed by the first printer and the second printer;

wherein the first printer includes:

a first jam detecting unit that detects a jam of the continuous-form printing paper at an upstream position where the first printer forms the first image on the continuous-form printing paper, the first jam detecting unit including a first web-jam detecting sensor, a first web-jam information receiving unit configured to determine whether a jam has occurred during printing based on a detection signal from the first web jam detecting sensor, and a first main control unit configured to communicate with the control unit so as to read information from each other and configured to receive web jam information transmitted from the first web jam information receiving unit;

a pre-heating unit that includes a pre-heating plate, and preliminarily heats the first-image-printed continuous-form printing paper prior to fixation; and a fixing unit that includes a heating roller, and fixes a not-yet-fixed image on the first-image-printed continuous-form printing paper onto the first-image-printed continuous-form printing paper, and the second printer includes:

a second jam detecting unit that detects a jam of the first-image-printed continuous-form printing paper on which the first image is fixed at an upstream position where the second printer forms the second image on the first-image-printed continuous-form printing paper, the second jam detecting unit including a second web-jam detecting sensor, a second web jam information receiving unit configured to determine whether a jam has occurred during printing based on a detection signal from the second web-jam detecting sensor, and a second main control unit configured to communicate with the control unit so as to read information from each other and configured to receive web-jam information transmitted from the second web-jam information receiving unit; and wherein, the second main control unit controls the second jam detecting unit such that the second jam detecting unit does not perform the jam detecting for a period of time M, over which a deformed portion of the first-image-printed continuous-form printing paper that has been at rest at the pre-heating unit of the first printer passes through a second detection position of the second jam detecting unit, the period of time M being a period of time used to determine a web-jam-error masking period defined by equation $M=Q/Z$, where Q is a distance from the pre-heating plate to the heating roller and Z is a print speed of the first and second printers, and the distance Q being the information received by the second main control unit from the control unit of the printing system.

2. The printing system according to claim 1, wherein the second printer further includes a storage unit, and the second main control unit calculates, every time the printing system resumes conveyance of the first-image-printed continuous-form printing paper, a timing the deformed portion of the first-image-printed continuous-form printing paper passes through the detection position of the second jam detecting unit, and the second main control unit stores the calculated timing in the storage unit.

3. The printing system according to claim 1, wherein the second main control unit calculates an error mask timing T which is a period of time that elapses before the deformed portion of the first-image-printed continuous-form printing paper reaches the second web jam detecting sensor based on a distance between a first position where the first printer starts forming the first image onto the continuous-form printing paper and a second position where the second printer forms the second image on the first-image-printed continuous-form printing paper.

4. The printing system according to claim 3, wherein the first printer further includes an adjusting unit that adjusts slack in the continuous-form printing paper, and the second main control unit calculates the error mask timing T by adding or subtracting an adjustment amount, which is amount of the slack in the continuous-form printing paper, to or from the distance between the first position and the second position.

5. The printing system according to claim 4, wherein the adjusting unit pivots and adjusts the slack in the continuous-form printing paper, the first printer further includes:

a position sensor unit that detects a pivot angle of the adjusting unit; and a transmitting unit that transmits the pivot angle detected by the position sensor unit to the control unit, the second printer further includes:

a receiving unit that receives the pivot angle detected by the position sensor unit from the control unit; and a storage unit that stores an adjustment-amount table, in which pivot angles of the adjusting unit and adjustment amounts are associated with each other, and the second main control unit obtains an adjustment amount associated with the pivot angle detected by the position sensor unit from the adjustment-amount table and calculates the error mask timing T by adding or subtracting the obtained adjustment amount to or from the distance between the first position and the second position.

6. The printing system according to claim 4, wherein the adjusting unit pivots about a pivot center to thereby adjust the slack in the continuous-form printing paper, the first printer further includes:

a position sensor unit that detects a pivot angle of the adjusting unit; and a transmitting unit that transmits, to the control unit, the pivot angle detected by the position sensor unit, amount of the adjusting unit, and a distance from the pivot center to the pre-heating unit, the second printer further includes a receiving unit that receives, from the control unit, the pivot angle detected by the position sensor unit, the amount of the adjusting unit, and the distance from the pivot center to the pre-heating unit, and the second main control unit calculates the adjustment amount based on the pivot angle detected by the position sensor unit, the amount of the adjusting unit, and the distance from the pivot center to the pre-heating unit, and calculates the error mask timing T by adding or subtracting the calculated adjustment amount to or from the distance between the first position and the second position.

7. The printing system according to claim 6, wherein the second main control unit calculates xl, which is distance between a distal end, which is on opposite side from the pivot center, of the adjusting unit located at a predetermined reference position and the pre-heating unit from following equation:

$$x1=B-A$$

where A is a length of the adjusting unit and B is a distance from the pivot center of the adjusting unit to the pre-heating unit, the second main control unit further calculates x2, which is a distance between the distal end of the adjusting unit and the pre-heating unit from following equation:

$$x2=\sqrt{(A^2+B^2-2AB\cos\theta)}$$

where θ is the pivot angle detected by the position sensor unit, the second main control unit further calculates the adjustment amount from following equation:

$$\Delta x=x2-x1$$

where Δx is the adjustment amount, and the second main control unit further calculates the error mask timing T by performing any one of addition of the calculated adjustment amount Δx to the distance between the first position and the second position and subtraction of the adjustment amount Δx from the distance.

8. A printing method to be performed in a printing system that includes a first printer that forms a first image on continuous-form printing paper to obtain a first-image-printed continuous-form printing paper, a second printer that receives the first-image-printed continuous-form printing paper fed from the first printer and forms a second image on the first-image-printed continuous-form printing paper, and a control unit that controls printing performed by the first printer and the second printer, the first printer including:

a pre-heating unit that preliminarily heats the continuous-form printing paper prior to fixation; and a fixing unit that performs the fixation by fixing a not-yet-fixed image onto the continuous-form printing paper, the printing method comprising:

performing a first jam detecting with a first jam detecting unit by detecting a jam of the continuous-form printing paper in the first printer at an upstream position where the first printer forms the first image on the continuous-form printing paper, the first jam detecting unit including a first web-jam detecting sensor, a first web-jam information receiving unit configured to determine whether a jam has occurred during printing based on a detection signal from the first web-jam detecting sensor, and a first main control unit configured to communicate with the control unit so as to read information from each other and configured to receive web-jam information transmitted from the first web-jam information receiving unit; and performing a second jam detection with a second jam detecting unit by detecting a jam of the first-image-printed continuous-form printing paper on which the first image is fixed in the second printer at an upstream position where the second printer forms the second image on the first-image-printed continuous-form printing paper, the second jam detecting unit including a second web jam detecting sensor, a second web jam information receiving unit configured to determine whether a jam has occurred during printing based on a detection signal from the second web-jam detecting sensor, and a second main control unit configured to communicate with the control unit so as to read information from each other and configured to receive web jam information transmitted from the second web-jam information receiving unit; and performing control with the second main control unit such that the second jam detection is not performed for a period of time M, over which a deformed portion of the first-image-printed continuous-form printing paper that has been at rest at the pre-heating unit of the first printer passes through a second detection position of the second jam detecting unit, the period of time M being a period of time used to determine a web-jam-error masking period defined by equation M=Q/Z, where Q is a distance from the pre-heating plate to the heating roller and Z is a print speed of the first and second printers, and the distance Q being the information received by the second main control unit from the control unit of the printing system.

9. The printing system according to claim 1, wherein each of the first and second web-jam detecting sensors is a pair of light-sensitive detectors respectively fixed to tractor doors of a web conveying unit.

10. The method of printing according to claim 8, wherein each of the first and second web jam detecting sensors is a pair of light-sensitive detectors respectively fixed to tractor doors of a web conveying unit.

11. The printing system according to claim 1, wherein the second main control unit is programmed to calculate an error mask timing T defined by equation T=(L-X-Y+K)/Z, where L is a length between a transfer point of the first printer and a transfer point of the second printer, X is a distance from the transfer point of the first printer to a leading end of a shooter of the first printer, Y is a distance from the web-jam detecting sensor of the second printer to the transfer point of the second printer, K is a distance from a nip formed between a pressure roller and a heating roller of the first printer to the leading end of the shooter of the first printer, and Z is a print speed of the printers, and wherein each of the first and second web-jam detecting sensors is a pair of light-sensitive detectors respectively fixed to tractor doors of a web conveying unit.

12. The method of printing according to claim 8, further comprising:

calculating an error mask timing T defined by equation T=(L-X-Y+K)/Z, where L is a length between a transfer point of the first printer and a transfer point of the second printer, X is a distance from the transfer point of the first printer to a leading end of a shooter of the first printer, Y is a distance from the web-jam detecting sensor of the second printer to the transfer point of the second printer, K is a distance from a nip formed between a pressure roller and a heating roller of the first printer to the leading end of the shooter of the first printer, and Z is a print speed of the printers, and wherein each of the first and second web-jam detecting sensors is a pair of light-sensitive detectors respectively fixed to tractor doors of a web conveying unit.

* * * * *